US008354924B1

(12) United States Patent
Goodwin

(10) Patent No.: US 8,354,924 B1
(45) Date of Patent: Jan. 15, 2013

(54) WATERPROOF AUDIO RECEIVING DEVICE WITH OBJECT DETECTION SYSTEM

(76) Inventor: Spencer Goodwin, Laurel, MD (US)

( * ) Notice: Subject to any disclaimer, the term of this patent is extended or adjusted under 35 U.S.C. 154(b) by 353 days.

(21) Appl. No.: 12/689,079

(22) Filed: Jan. 18, 2010

(51) Int. Cl.
*G08B 1/08* (2006.01)
*G08B 23/00* (2006.01)

(52) U.S. Cl. ..... 340/539.11; 340/539.22; 340/573.6; 340/621; 340/604

(58) Field of Classification Search ..... 340/539.11, 340/539.22, 539.23, 573.6, 621, 604; 381/77, 381/24, 187; 455/100, 351, 66.1; 367/130
See application file for complete search history.

(56) References Cited

U.S. PATENT DOCUMENTS 5,251,326 A * 10/1993 Silverman ..... 455/40
5,347,273 A * 9/1994 Katiraie ..... 340/903
5,537,667 A * 7/1996 Kenning et al. ..... 381/386
5,600,730 A * 2/1997 Kenning et al. ..... 381/77
5,813,056 A * 9/1998 Ambrose ..... 2/452
5,815,126 A * 9/1998 Fan et al. ..... 345/8
7,401,918 B2 * 7/2008 Howell et al. ..... 351/158
7,735,230 B2 * 6/2010 Barany ..... 33/354
7,980,998 B2 * 7/2011 Shemesh et al. ..... 482/8
8,073,153 B2 * 12/2011 Loeppert ..... 381/74
8,111,859 B2 * 2/2012 Phillips ..... 381/376
2005/0124234 A1 * 6/2005 Sells et al. ..... 440/33
2008/0057806 A1 * 3/2008 Blumberg ..... 441/129
2008/0181429 A1 * 7/2008 Fried ..... 381/87
2009/0006675 A1 * 1/2009 Rofougaran ..... 710/62

* cited by examiner

*Primary Examiner* — Daniel Wu
*Assistant Examiner* — Mancil Littlejohn
(74) *Attorney, Agent, or Firm* — Gulf Coast Intellectual Property Group

(57) ABSTRACT

A system for facilitating the instructional training of a swimmer wherein the system is further operable to provide object detection to the swimmer of an object within the general movement path of the swimmer. The system further includes a transmitter wherein the transmitter is configured to broadcast at least two audio signals. A receiver is operably coupled to the transmitter utilizing a wireless frequency. The receiver further includes a left earpiece and a right earpiece that have intermediate therebetween two headbands for releasably securing the receiver to the head of the swimmer. The receiver further includes a plurality of sensors mounted to the first headband that are configured to generate and receive sound pulses in order to detect an object within the general movement path of the user.

11 Claims, 3 Drawing Sheets

WATERPROOF AUDIO RECEIVING DEVICE WITH OBJECT DETECTION SYSTEM

FIELD OF THE INVENTION

The present invention relates to an instructional facilitator for producing audio signals, more specifically but not by way of limitation, an audio headphone device designed to be submersible in water and receive at least one type of audio signal from a wireless transmitter utilizing a 900 mhz frequency.

BACKGROUND

Millions of individuals engage in various physical activities for exercise to improve their cardiovascular condition. Additionally, athletes on a professional or amateur level compete in a variety of sports that wherein the participants utilize coaches or facilitators to provide guidance and/or motivation. Once such sport that utilizes coaches is swimming. Swimming is a popular sport across all age groups and is participated in at a competitive as well as an amateur level either for recreational exercise therapy or at a competitive level.

While engaged in swimming, participants typically will practice for at least an hour utilizing various strokes in order to traverse themselves across the surface of the water of the pool. Additionally, during some maneuvers such as starts and turns, individuals will be completely submersed underwater. To perfect strokes and increase their ability, athletes utilize coaches who can observe the athletes strokes while standing adjacent to the pool. It is routine for coaches to attempt to communicate with the athlete during their practice in order to provide better training or correction of an observed opportunity for improvement. Routinely coaches will either yell or utilize a megaphone or other similar device in order for the athlete to be able to hear the instructions since it is common for the athlete to be in a position where at least one of their ears is underwater. This conventional routine makes receiving the coaching instructions by the athlete difficult and routinely the athlete may stop their stroke in order to inquire about instructions received from the coach.

Athletes in swimming will often engage in a swimming practice that can last an extended period of time. It is common for athlete that engage in monotonous activities such as running, cycling or swimming to utilize devices such as MP3 or other audio players to listen to motivational instructions and/or music to assist them during the duration of their routine. Currently these type of audio device can not withstand being submersed in the water and must often be carried in water proof pouches that are cumbersome to a swimmer and provide unwanted drag in the water.

Casual athletes also have been shown to have accidental contact with either another swimmer in a crowded pool or with a wall of the pool when engaged in swimming. Certain conditions arise such as turbulent water, fogged swimming goggles or other conditions that temporarily inhibit the vision of the swimmer, which can result in a collision with another swimmer or an impact with the wall of the pool.

Accordingly, there is a need for a device that can be worn by a swimmer in the water that does not increase the swimmer's drag resistance that has the ability to receive audio signals from a transmitter in order to facilitate the receipt of instructions from a coach or receipt of audio such as music or motivational instructions. Additionally, the device should be able to detect the presence of an object generally in front of the swimmer wearing the device and provide an audio warning to the swimmer that an object is proximate the swimmer so as to avoid a collision.

SUMMARY OF THE INVENTION

It is the object of the present invention to provide a waterproof listening device that is releasably secured to the head of a swimmer in order to receive audio signals.

Another object of the present invention is to provide waterproof listening device that is releasably secured to the head of a swimmer that receives audio signals from a transmitter that is adjacent the body of water in which the swimmer is located.

A further object of the present invention is to provide a waterproof listening device that receives the audio signal from the transmitter utilizing a wireless transmission having a frequency of 900 mhz.

Yet another object of the present invention is to provide a water-proof listening device that further includes a detection system that alerts the swimmer when an object is in the swim path of the swimmer and a collision with the object is imminent.

Still a further object of the present invention is to provide a waterproof listening device that further includes a detection system that utilizes and audio signal to alert the swimmer of an impending collision with an object in their swim path.

Another object of the present invention is to provide a waterproof listening device that further includes a detection system that utilizes an audio signal having increased signal production as the distance between the swimmer and the object decreases.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
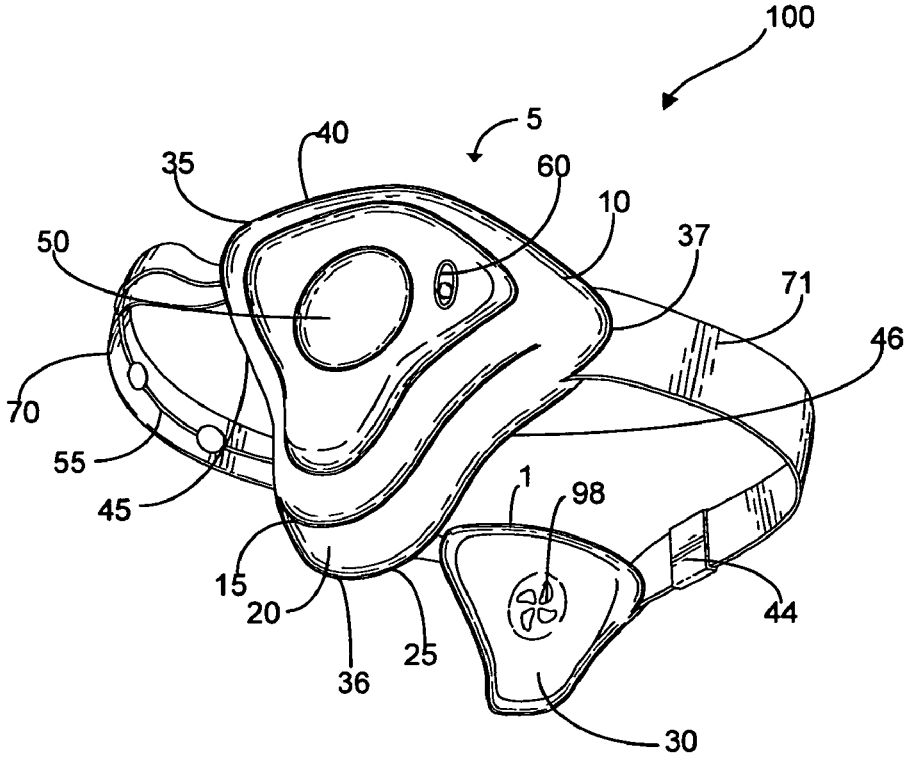
FIG. 1 is a left perspective view of an embodiment of the present invention.

Referring now to the drawings submitted herewith, wherein various elements depicted therein are not necessarily drawn to scale and wherein through the views and figures like elements are referenced with identical reference numerals, there is illustrated a headphone 100 constructed according to the principles of the present invention.

Referring in particular to FIG. 1 the headphone 100 further includes a left earpiece 5 that has generally a modified triangular shaped body 10 being designed to substantially cover the left ear of a user. The body 10 is manufactured from a suitable durable material such as but not limited to Kevlar or graphite or a combination thereof. The body 10 is shaped in a modified triangular shape so as to reduce the drag from the headphone 100 when being worn by a user in a pool. The body 10 has a leading corner 35 the directs the water around the upper edge 40 and the lower edge 45 so as to substantially reduce the drag of the headphone 100 when a user is traversing across a pool of water. The upper edge 40 and lower edge 45 are concave in shape so as to further reduce water drag. The rearward edge 46 is formed in the same manner. Additionally, the leading corner 35 is rounded in shape with the other two corners 36,37 of the body 10 being constructed in a similar manner. The body 10 is manufactured to be lightweight as well as having an exterior surface 15 that is impermeable to water. Circumferentially disposed around the perimeter 20 of the body 10 is a sealing edge 25. The sealing edge 25 is manufactured from a flexible resilient material such as but not limited to rubber. The sealing edge 25 functions to substantially inhibit water from propagating into the cavity 30 during use when engaged with the head of the user. Those skilled in the art will recognize that the sealing edge 25 could be manufactured in numerous different thicknesses and from numerous different types of materials so as to accomplish the intended function as described herein.

Although not illustrated specifically in FIG. 1, the left earpiece 5 has disposed therein a conventional lithium ion battery that supplies power to the headphone 100 for operation. The conventional lithium ion battery is accessed and replaced through the hatch 50 and is replaced as needed by the user. Disposed within the left earpiece 5 is a conventional speaker 98 that is used to project the audio signals received by the antenna 55. The speaker 98 is a conventional waterproof speaker as is known in the art and is adjacent the user's ear subsequent the user engaging the headphone 100 with their head. Also mounted within the left earpiece 5 and right earpiece 1 but not illustrated herein is a conventional central processing computer chip that functions to receive, process, store signals that are received from the antenna 55 and the sensors 65.

Operably coupled to the left earpiece 5 is the right earpiece 1. The right earpiece 1 is manufactured in an identical manner as the left earpiece 5 as described herein. A first band 70 and a second band 71 are intermediate the left earpiece 5 and the right earpiece 1. The first band 70 and the second band 71 function to couple the left earpiece 5 and the right earpiece 1. The second band 71 further includes a tension mechanism 44 that functions to provide the user the ability to adjust the length of the second band 71 in order to provide a higher bias force of the left earpiece 5 and right earpiece 1 against the user's head. The first band 70 and the second band 71 are integrally secured to the left earpiece 5 and right earpiece 1 using suitable durable methods. The first band 70 and second band 71 are manufactured from a suitable durable material such as but not limited to neoprene and/or nylon. The first band 70 and the second band 71 have a resilient quality such that subsequent a user engaging the headphone 100 with their head, the first band 70 and the second band 71 bias the left earpiece 5 and the right earpiece 1 against the user's head so the sealing edge 25 has sufficient pressure thereon to substantially inhibit water from propagating into the cavity 30. Those skilled in the art will recognize that the first band 70 and the second band 71 could be manufactured from numerous different materials and still perform the intended function as described herein. It is further contemplated within the scope of the present invention that the headphone 100 could have as few as one band in place of and/or in conjunction with the first band 70 and the second band 71.

Integrally mounted within the body 10 of the left earpiece 5 is a switch 60. The switch 60 is a conventional waterproof switch as is known in the art and functions to transition the headphone 100 from a first mode to a second mode. In a first mode, the headphone 100 functions to receive audio signals from the transmitter 99 as shown in particular in FIG. 4. The transmitter 99 is a conventional audio signal generator that generates audio signals and broadcasts the signals utilizing a wireless frequency. More specifically but not by way of limitation, the transmitter 99 is configured to broadcast audio signals utilizing wireless frequencies of 900 Mhz, 2.4 Ghz or 5.8 Ghz. The antenna 55 receives the audio signals and transmits the audio signals to the speakers 98 within the left earpiece 5 and the right earpiece 1. The antenna 55 is a conventional antenna that is manufactured from a suitable flexible material and is operably coupled to the speakers disposed within the left earpiece 5 and the right earpiece 1.

Figure 4:
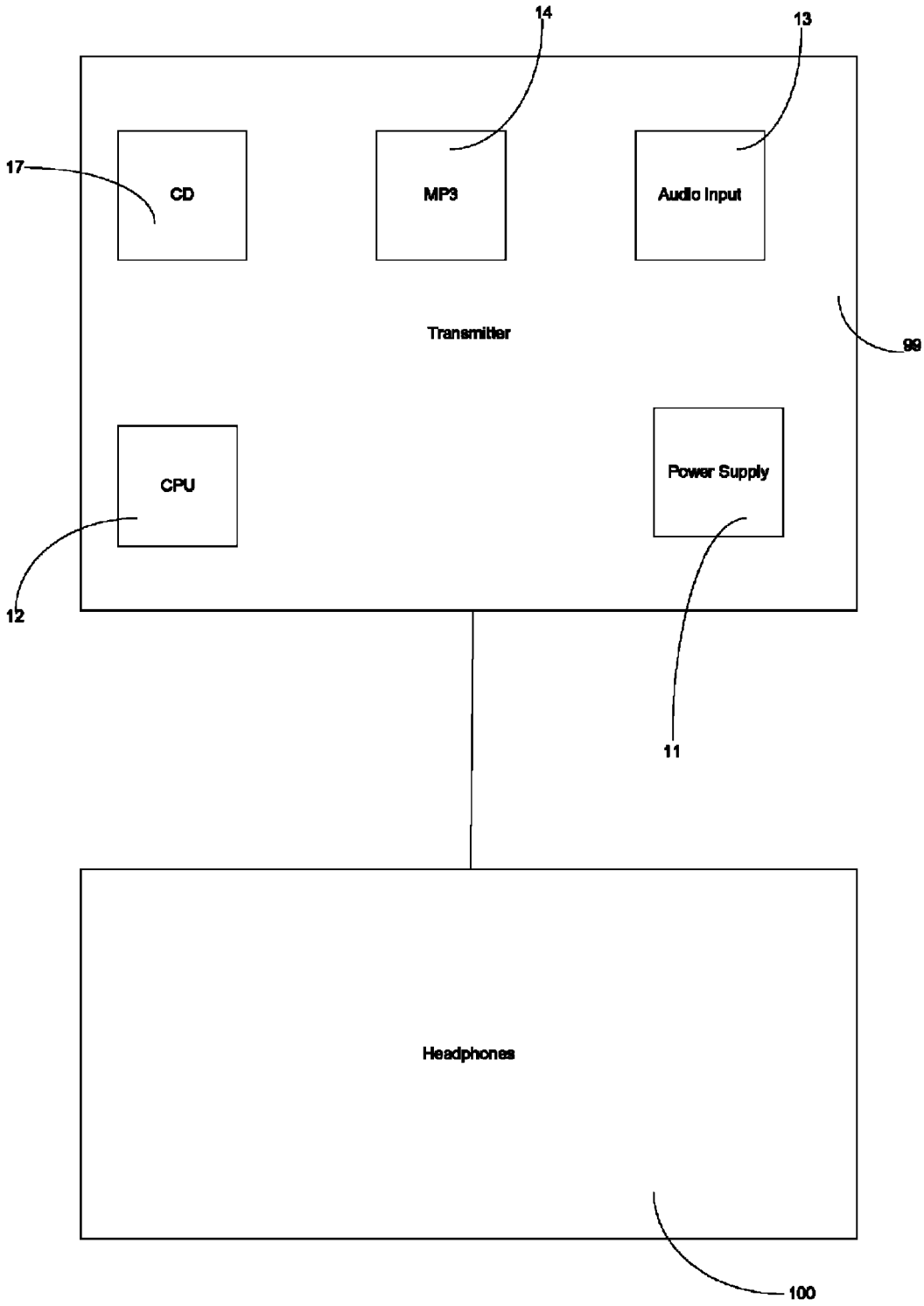
FIG. 4 is a schematic view of an embodiment of the present invention.

As shown in particular in FIG. 4, the switch 60 when moved to its second position places the headphones 100 in their second mode. In their second mode the headphones 100 function to provide a user engaged therewith object detection capabilities. Disposed along the antenna 55 within the first band 70 are a plurality of sensors 65. The sensors 65 are operably coupled to the antenna 55 and function to generate and receive sound pulses outward from the first band 70. The sensors 65 are conventional active sonar sensors that function to provide a method of detecting an object within the general movement path of the swimmer such as but not limited to another swimmer or an approaching wall. The sensors 65 transmit the sound pulses and further function to receive the reflection of the sound pulses reflected from any object generally within the movement path of the swimmer wearing the headphones 100. The conventional central processing unit disposed within the left earpiece 5 is operably coupled to the antenna 55 and sensors 65. The conventional central processing unit processes the amount of time between transmission of the sound pulse from the sensor 65 and the reception of the reflected sound pulse from an object in the general movement path of the swimmer and determines the distance between the object and the user engaged with the headphones 100 using a programmed algorithm. The central processing unit subsequent to detecting an object in the general movement path of the user will then send an audio warning signal to the user via the speakers 98. In the second mode the sensors 65 constantly monitor the movement path of the swimmer utilizing sound pulses. Subsequent to an object being detecting by the sensor 65 and a first audio warning signal being sent to the speakers 98, the ensuing audio warning signals sent to the user increase in frequency of generation as the distance between the user and the object decreases. This method is utilized to alert the user of the headphones 100 of an impending collision with an object that is within their general movement path. Those skilled in the art will recognize that any number of sensors 65 could be disposed along the first band 70. It should be further recognized that the location of the sensors 65 could be altered and still perform the function as described herein.

Figure 2:
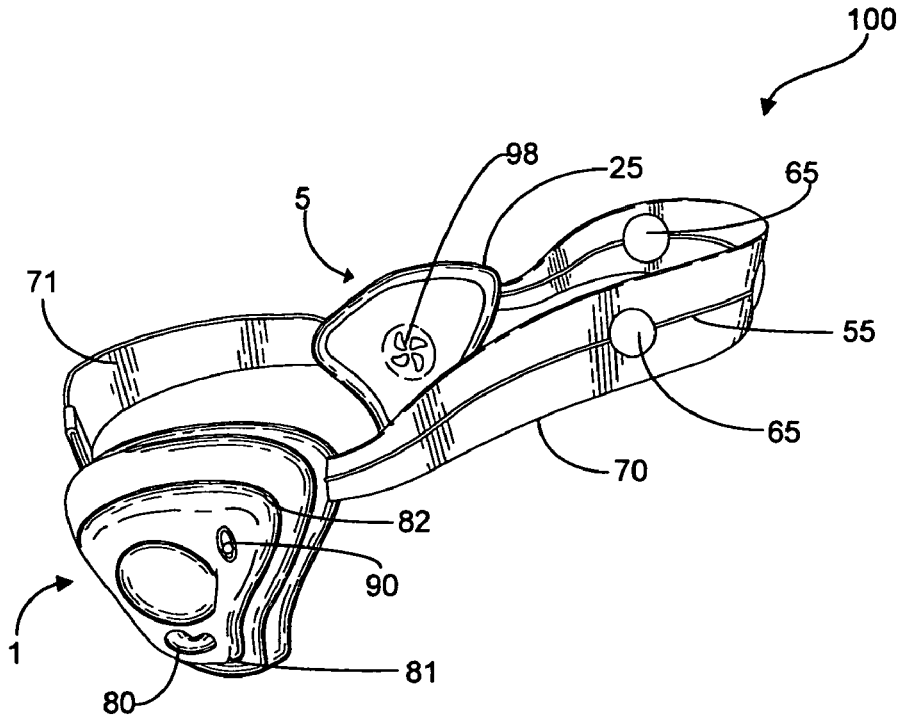
FIG. 2 is a right perspective view of an embodiment of the present invention.

Referring in particular to FIG. 2, the right earpiece 1 further includes a volume switch 80. The volume switch 80 is integrally mounted into the lower portion 81 of the right earpiece 1 and is a conventional waterproof rotary style switch that functions to provide an interface to the user to control the volume of the audio signals in either the first mode or second mode of the headphone 100. A power switch 90 is integrally mounted into the right earpiece 1 proximate the upper portion 82. The power switch 90 is operably coupled to the conventional lithium ion batteries that are disposed within the left earpiece 5 and right earpiece 1. The power switch 90 is a conventional waterproof toggle style switch that functions to supply power to the headphone 100 when moved from it first position to its second position.

Referring in particular to FIG. 4, a schematic diagram of the transmitter 99 is illustrated therein. The transmitter 99 is a conventional audio transmitter that functions to produce a plurality of audio signals and broadcast the audio signals to the headphone 100 utilizing the wireless frequencies referenced herein. The transmitter 99 includes a conventional power source 11 that is operably coupled to a conventional AC power outlet. The power source functions to provide the power required for the transmitter 99 to operate. Disposed within the transmitter 99 is a conventional central processing unit 12 that contains the necessary electronics to receive, process and broadcast audio signals. The transmitter 99 further includes an audio input interface 13. The audio input interface 13 is a conventional interface that allows a device such as but not limited to a conventional microphone to be operably connected to the transmitter 99. Utilizing the audio input interface 13 allows a user of the headphone 100 to receive audio signal such as but not limited to instructional information from an individual while engaged in a swimming stroke. The transmitter 99 further includes a conventional mp3 player 14 and a compact disc player 17. The mp3 player and compact disc player 17 function to play recorded sound tracks to be broadcast by the transmitter 99 and received by the headphone 100. Those skilled in the art will recognize that numerous different types of recorded audio players could be incorporated into the transmitter 99. It is further contemplated within the scope of the present invention that the transmitter 99 is placed proximate the pool in which the swimmer is engaged with the headphone 100. Those skilled in the art will recognize that utilizing the different frequencies referenced herein would allow the transmitter 99 to be utilized at different distances from the pool.

Figure 3:
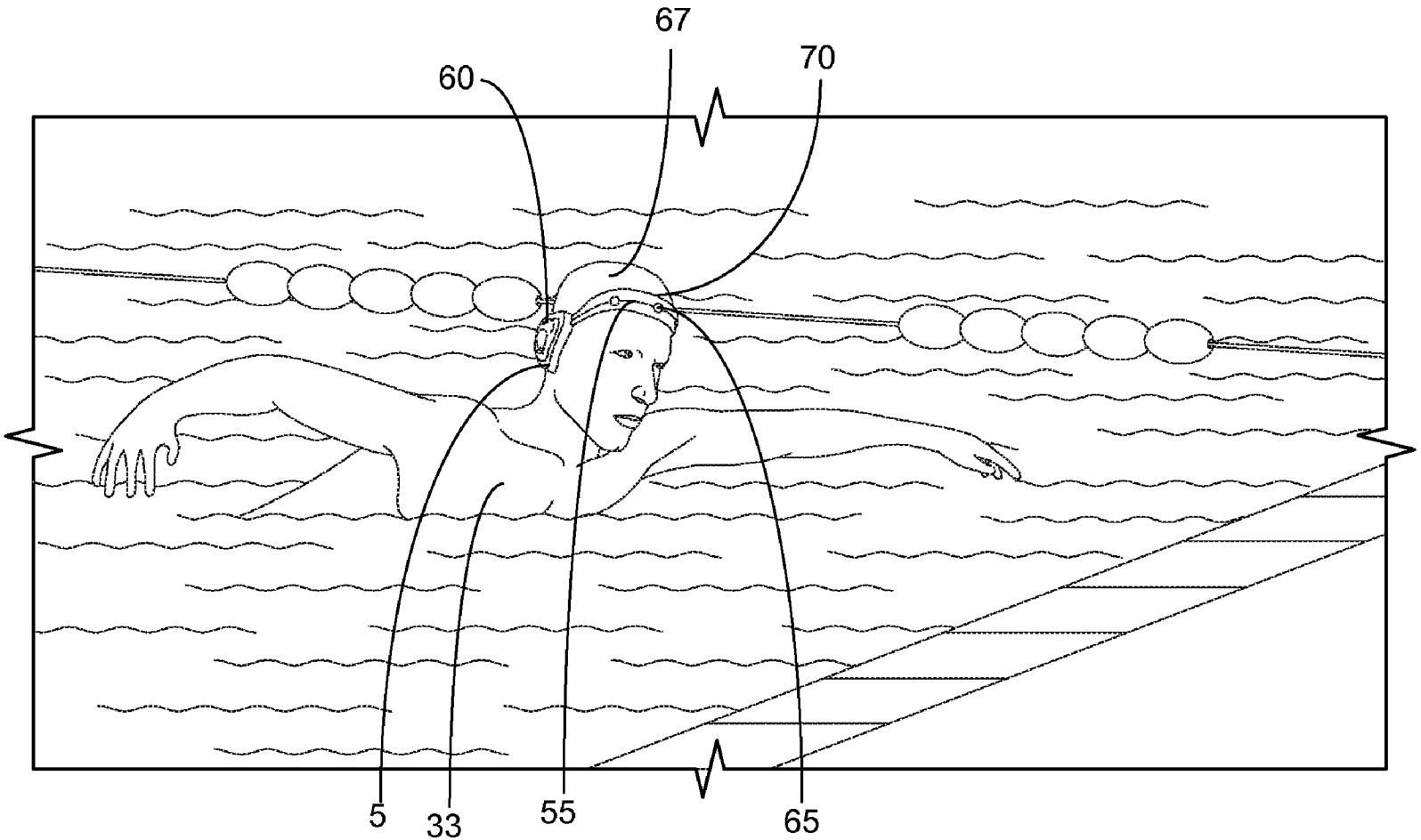
FIG. 3 is a perspective view of an individual wearing an embodiment of the present invention while engaged in swimming in a pool of water.

Referring in particular to FIGS. 2,3 and 4 a description of the operation of the headphone 100 is as follows. In use, a user will engage the headphone 100 with their head 67 such that the left earpiece 5 and the right earpiece 1 are adjacent and substantially covering the left ear and right ear respectively. The user will adjust the second band 71 so as to alter the bias force of the sealing edge 25 against the head 67 in order to provide sufficient bias force wherein the sealing edge 25 substantially inhibits the water 77 from propagating into the cavity 30. The user then ensures that the transmitter 99 is operably coupled to the required power source prior to entering the water 77. The user engages the power switch 80 to activate the headphone 100. The user will engage switch 60 to operate the headphone 100 in either a first or a second mode. When the switch 60 is placed in its first position the headphone 100 will operate in its first mode wherein the headphone 100 functions to receive audio signals from the transmitter 99 that is being produced by either the audio input interface 13, mp3 player 14 or compact disc player 17. In the first mode the transmitter 99 broadcasts an audio signal via a wireless frequency such as but not limited to 900 mhz. The antenna 55 receives the audio signal and transmits the audio signal to the speakers 98. The volume of the audio signal can be adjusted by the user utilizing the volume switch 80. If the switch 60 is placed in its second position, the headphone 100 will operate in their second mode. In their second mode, the headphone 100 function to provide object detection of any object that is within the general movement path of the swimmer 33. In its second mode, the headphone 100 utilizes the plurality of sensors 65 disposed along the first band to generate and receive sound pulses. Subsequent to an object being present within the general movement path of the swimmer 33 the sensor 65 will receive the reflection of the sound pulse from the object within the general movement path of the swimmer 33. A central processing unit disposed within the left earpiece 5 and operably connected to the sensor 65 by suitable methods calculates the distance between the swimmer 33 and the object within the swimmer's 33 general movement path. The central processing unit generates an audio warning signal to the user via the speaker 98 to alert the swimmer 33 that an object has been detected within their general movement path. In the second mode, the headphone 100 will increase the frequency of the generation of the audio warning signal as the distance between the swimmer 33 and an object within the swimmer's general movement path decreases. While it is contemplated within the scope of the present invention that the headphone 100 will operate in the first and second mode as described herein independently, it is further contemplated within the scope of the present invention that the headphone 100 could be operated in a third mode. In the third mode the headphone 100 would be operable to perform the functions as described herein of the first mode and the second mode simultaneously. Additionally, while the preferred embodiment described herein is utilized for providing at least one audio signal to a swimmer 33, it is further contemplated within the scope of the present invention that the headphone 100 and transmitter 99 could be utilized to provide audio signals to other athletes engaged in other sports.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A system for transmitting an audio signal to a swimmer in a pool and further provide object detection comprising:

a transmitter, said transmitter being proximate the pool, said transmitter further including an integrated circuit board for receiving, processing and broadcasting at least one audio signal, said transmitter configured to broadcast said at least one audio signal utilizing a wireless frequency, a receiver, said receiver releasably secured to the head of the swimmer, said receiver operable to receive said at least one audio signal from said transmitter, said receiver being waterproof, said receiver further including a left earpiece and a right earpiece, said receiver further having a headband intermediate said left earpiece and said right earpiece, said headband having a front portion and a rear portion, said front portion being proximate the forehead of the swimmer, said rear portion extending in an opposing direction from said front portion engaging a rear portion of the head of the swimmer;

at least one sensor, said at least one sensor being integrally mounted to said front portion of said headband, said at least one sensor operable to detect an object within the path in front of the swimmer;

wherein the system is operable in a first mode, a second mode, and a third mode wherein in said first mode said receiver receives said at least one audio signal from said transmitter; and wherein said left earpiece and right earpiece are modified triangular in shape, said left earpiece and said right earpiece having a concave edge intermediate three corners, said three corners being rounded in manner, said left earpiece and said right earpiece being secured to the swimmer's head such that one of the three corners is positioned as a leading corner and is directed to initially engage the stream of water flowing past the swimmer's head.

2. The system as recited in claim 1, wherein said at least one sensor generates and receives sound pulses to detect an object within the path in front of the swimmer.

3. The system as recited in claim 2, wherein in said second mode said at least one sensor is operable to detect an object within the path in front of the swimmer and provide an audio signal to alert the swimmer of the detected object and wherein the frequency of occurrence of the audio signal is greater when the detected object is closer to the swimmer.

4. The system as recited in claim 3, wherein said receiver further includes a switch, said switch operable to transition the system between said first mode, said second mode and said third mode, in said third mode the system operates in said first mode and said second mode simultaneously.

5. The system as recited in claim 4, wherein said transmitter further includes at least one of the following audio devices: a MP3 player or a compact disc player.

6. A system configured to transmit two audio signals to a swimmer in a pool and wherein the system is further operable to provide collision avoidance for the swimmer comprising:

a transmitter, said transmitter being proximate the pool, said transmitter having an integrated circuit board configured to receive, process and broadcast said two audio signals, wherein said first audio signal is received from a microphone operably coupled with said transmitter, said transmitter further including a power supply, said power supply operable to provide power to said transmitter, said transmitter operable to broadcast said two audio signals utilizing a wireless frequency;

a receiver, said receiver operably connected to said transmitter, said receiver configured to receive said two audio signals, said receiver further including a left earpiece and a right earpiece, said left earpiece and said right earpiece being modified triangular in shape having three rounded corners with concave edges intermediate each of the three rounded corners so as to reduce water drag, said receiver being waterproof, said left earpiece and said right earpiece further having an audio speaker disposed therein, said receiver further including a first headband and a second headband, said first headband being proximate the forehead of the swimmer;

a plurality of sensors, said plurality of sensors being mounted on said first headband, said plurality of sensors configured to generate and receive sound pulses, said plurality of sensors operable to detect an object within the path in front of the swimmer; and wherein the system is operable in a first, a second mode and a third mode.

7. The system as recited in claim 6, wherein in said first mode said receiver receives said two audio signals from said transmitter.

8. The system as recited in claim 7, wherein in said second mode said plurality of sensors are operable to detect an object within the path in front of the swimmer and provide an audio signal to alert the swimmer of the detected object.

9. The system as recited in claim 8, wherein said plurality of sensors are sonar sensors.

10. The system as recited in claim 9, wherein the audio signal in said second mode has an emission frequency that is greater as a detected object is more proximate the swimmer.

11. The system as recited in claim 10, wherein said receiver further includes a switch, said switch operable to transition the system between said first mode, said second mode and said third mode, in said third mode the system operates in said first mode and said second mode simultaneously.

* * * * *